US006348428B1

(12) United States Patent
Misu et al.

(10) Patent No.: US 6,348,428 B1
(45) Date of Patent: Feb. 19, 2002

(54) HIGH-PURITY CRYSTALLINE INORGANIC FIBER, MOLDED BODY THEREOF, AND METHOD OF PRODUCTION THEREOF

(75) Inventors: Yasuo Misu; Mikiya Fujii, both of Tokyo; Kazuhide Kawai, Hatano-si; Fumio Tokuoka, Hatano-si; Makoto Takahashi, Hatano-si; Keiji Morita, Hatano-si, all of (JP)

(73) Assignee: Toshiba Monofrax Co., Ltd., Tokyo (JP)

( * ) Notice: Subject to any disclaimer, the term of this patent is extended or adjusted under 35 U.S.C. 154(b) by 0 days.

(21) Appl. No.: 09/500,452

(22) Filed: Feb. 9, 2000

(30) Foreign Application Priority Data

Feb. 23, 1999 (JP) ..... 11-045157
Jan. 13, 2000 (JP) ..... 2000-004635

(51) Int. Cl.[7] ..... C04B 35/00

(52) U.S. Cl. ..... 501/95.1; 501/127; 501/128; 501/103; 501/133; 501/264; 501/640; 501/423; 501/335; 501/608; 501/625

(58) Field of Search ..... 501/95.1, 127, 501/128, 133, 103; 423/335, 608, 625; 264/640

(56) References Cited

FOREIGN PATENT DOCUMENTS

| | | | |
|---|---|---|---|
| JP | 10-7476 | | 1/1998 |
| JP | 10-130961 | * | 5/1998 |
| JP | 10-292229 | * | 11/1998 |
| JP | 11-43826 | * | 2/1999 |
| JP | 11-247029 | * | 6/2000 |
| JP | 2000-160434 | * | 6/2000 |

OTHER PUBLICATIONS

Shuji Omiya; Patent Abstract of Japan, Publication No. 11247029, Sep. 1999.
Toshio Horikoshi; Patent Abstract of Japan, Publication No. 10130961, May 1998.
Hiroyuki Terada; Patent Abstract of Japan, Publication No. 11043826, Feb. 1999.

* cited by examiner

*Primary Examiner*—Karl Group
(74) *Attorney, Agent, or Firm*—Foley & Lardner

(57) ABSTRACT

A crystalline inorganic fiber or molded body thereof is thermally treated in gas atmosphere containing chlorine. The crystalline inorganic fiber or molded body thereof contains small impurities such as Fe, Cu and Ni. For example, Fe is 15 ppm or less, Cu is 1 ppm or less, and Ni is 0.5 ppm or less.

13 Claims, No Drawings

HIGH-PURITY CRYSTALLINE INORGANIC FIBER, MOLDED BODY THEREOF, AND METHOD OF PRODUCTION THEREOF

FIELD OF THE INVENTION

This invention relates to a crystalline inorganic fiber low in impurities, a molded body mainly started from such a crystalline inorganic fiber, and the production of such inorganic fiber and molded body. This invention relates, particularly, to a high-purity crystalline inorganic fiber suitable for a semiconductor manufacturing device, a molded body of the inorganic fiber, and a method for producing the inorganic fiber.

DESCRIPTION OF THE RELATED ART

Inorganic fibers generally used as furnace material include amorphous fiber and crystalline fiber. The crystalline fiber includes fibers having at least one of alumina, silica and zirconia as main component. Most of them are used as a high-temperature heat insulating material for industrial furnace and the like.

In the production of the crystalline inorganic fiber, a liquid containing the concerned metal elements is regulated together with a fiberization assistant to a highly viscous solution, discharged through a small hole, and then dried in the atmosphere to form a precursor fiber. The precursor fiber is thermally decomposed to form a calcined fiber. This calcined fiber is further thermally treated at a high temperature, whereby crystals according to the fiber composition are precipitated to form a final product.

Examples of the products of the crystalline inorganic fiber include a product consisting of the manufactured fiber as it is, for example, a flocculent bulk product; and a product consisting of the fine chip powder and molded body of the fiber, for example, a molded product such as a blanket or mat obtained by molding the fiber by dry method or a felt, paper, or board molded by wet method, a monolithic product such as a kneaded matter, and the like.

According to the recent promotion of the higher quality of industrial products in part, a high-purity material never polluting a matter to be heated has been desired even in respect to industrial furnaces.

As a conventional method for producing the high-purity inorganic fiber, it is known to use a high-purity raw material according to the required purity.

Japanese Patent Application Laid-Open No. 11-43826, for example, discloses a high-purity alumina silica crystalline inorganic fiber started from a material in which the impurities in a raw material solution are reduced by means of ion exchange or the like.

A method for making the molded body more pure is disclosed in Japanese Patent Application Laid-Open No. 10-7476. The thermal treatment electric furnace material described therein is obtained by baking a molded body started from alumina and silica powder at 1500–1800° C., and then thermally treating it in gas atmosphere containing hydrogen chloride, chlorine gas or the like for 25–50 hours.

The raw material for crystalline inorganic fiber generally contains alkali metal such as Na, alkali earth metal such as Ca, transition metal such as Fe, and Ti as impurities. The crystalline inorganic fiber produced from the raw material containing these impurities contains these impurities.

In the manufacture of a semiconductor, the process of heating a wafer at a high temperature is frequently adapted. Examples of the device used for this process include an epitaxial device, a diffusion furnace, an annealing furnace, an etching device, an ashing device, a high temperature furnace for CVD and the like.

Such a device is formed of a heating element, a heat insulating material, a soaking pipe, a wafer holding member, and an atmospheric gas feeding and exhausting system.

The materials of the members used therein are limited. The holding member directly making contact with the wafer and the soaking pipe surrounding the atmosphere are limited to quartz glass and silicon carbide except some of etching devices. This reason is that these materials can eliminate the influence of the impurities on the silicone wafer to be thermally treated without substantially having a different kind of element other than oxygen and carbon.

Beside heat insulating property, the heat insulating material requires characteristics such as heat resistance, chemical stability and electric insulating property. A ceramic heat insulating material is used from this reason. However, pollution of the wafer with this heat insulating material is strictly limited. The heat insulating material is generally considered to be a pollution source, and in order to prevent the pollution with the heat insulating material, the soaking pipe is provided between the heat insulating material and the wafer.

As the member for the semiconductor manufacturing device, particularly, quartz glass is frequently used because the quartz glass is excellent in heat resistance and thermal impact resistance with high purity and can easily provide various forms of members by glass working.

In a high-temperature furnace, the heat insulating material is hardly used in contact with or adjacent to quartz glass, because the quartz glass is likely to devitrify.

Quartz glass is a material considered to be the supercooled liquid of silica, which precipitates cristobalite crystal when a condition of crystallization is imparted. The cristobalite has a thermal expansion coefficient different from quartz glass, and the part where crystallization progressed is cracked and seen opaque. Such a phenomenon is called devitrification, which is the typical deterioration form of quartz glass. Besides the deterioration of the member, this devitrification is an undesirable phenomenon in the sense that impurities are present enough to cause the devitrification.

With respect to the devitrification (crystallization) of quartz glass, alkali metal such as Na is famous as the nuclei generating agent and grow promoter thereof. Alkali earth metal such as Ca is also a typical element devitrifying quartz glass.

On the other hand, there has been a strong demand toward the use of the heat insulating material in contact with quartz glass, because this can enhance the freedom in device design to manufacture a highly functional compact device at a low cost. Namely, a heat insulating material having a small content of alkali metal or alkali earth metal or never releasing it, even if contained, has been desired.

In the most advanced device manufacture, pollution with heavy metal such as Fe, Cu, Ni or the like is avoided. Particularly, Cu and Ni are known as elements apt to pollute with high diffusing speed in silicon or silicon oxide such as quartz glass. It is considered that the pollution sufficiently progresses when the content of such a heavy metal element contained in the thermal treatment member of the silicone wafer is 2 ppm or more.

Cu, Ni and Na easy pass through quartz glass with high diffusing speeds in quartz glass. Thus, in order to manufacture a device extremely avoiding the pollution therewith, a further countermeasure is required.

In the method disclosed in Japanese Patent Application Laid-Open No. 10-7476, which is shown as this countermeasure, the reaction area is small, a long time is required for the thermal treatment, and productivity is poor as well as the complicated working process.

In the technique of enhancing the purity shown in Japanese Patent Application Laid-Open No. 11-43826, removable elements are limited, and the degree of removal of impurity is also insufficient.

SUMMARY OF THE INVENTION

This invention has an object to provide a high-purity crystalline inorganic fiber sufficiently low in the content of impurities, a molded body consisting of such an inorganic fiber, and a method for producing such an inorganic fiber.

A preferable solving means of this invention comprises a high-purity crystalline inorganic fiber, a molded body thereof, and a method for producing the same according to Claims 1–13.

In the manufacture of a high-purity crystalline inorganic fiber or molded body thereof according to this invention, impurities are removed by a thermal treatment in gas atmosphere containing chlorine.

The method of this invention can be realized, for example, by adding the process of removing impurities by a thermal treatment in gas atmosphere containing chlorine to a known manufacturing process in the manufacture of a crystalline inorganic fiber or molded body thereof. Such a process of impurity removal (referred also to as purification) may be performed in the middle of the fiber manufacture or as the final process thereof.

As the chlorine source, chlorine gas, hydrogen chloride, ammonium chloride and the like are suitably usable. The chlorine generated by decomposition of a gas containing chlorine element such as fleon is further usable. In the manufacture of the fiber, the raw material is often thermally decomposed to generate hydrogen chloride, and this hydrogen chloride can be also used.

The high-purity crystalline inorganic fiber according to this invention and the molded body consisting of the inorganic fiber can be produced by thermally treating a crystalline inorganic fiber in gas atmosphere containing chlorine to remove impurities.

As the crystalline inorganic fiber, a fiber mainly composed of at least one of alumina, silica and zirconia is suitable. Particularly, a fiber composed of alumina and silica or a fiber composed of alumina, silica and zirconia is particularly suitable. A fiber containing silica and produced by sol-gel method such as a fiber composed of yttria and silica is further suitable. A fiber produced by sol-gel method as carbon fiber is also suitable.

Preferable examples of raw materials for the concrete fiber manufacture are described below with respect to alumina silica fiber. As the alumina source, a chloride such as basic aluminum chloride, an inorganic acid salt such as nitrate, an organic acid salt such as acetate, and aluminum alkoxide are preferably used. As the silica source, colloidal silica, water-soluble silicone, and alkoxide solution of silicon are preferred. As the fiberization assistant, a water-soluble organic polymer such as lactic acid or polyvinyl alcohol is preferably used.

The impurities contained in the high-purity crystalline inorganic fiber and molded body thereof according to this invention contain 15 ppm or less of Fe, 1 ppm or less of Cu, and 0.5 ppm or less of Ni; preferably, 10 ppm or less of Fe, 0.5 ppm or less of Cu, and 0.2 ppm or less of Ni. More preferably, Na is 50 ppm or less. Further more preferably, Ca is 75 ppm or less. When the contents of the impurities exceed these values, the impurities pollute quartz glass and cause the pollution of a matter to be heated. Further, the crystal growth of the fiber might be promoted by heating to deteriorate the fiber, resulting in a reduction in the strength and heat resistance.

The crystalline inorganic fiber is generally obtained by thermally decomposing a precursor fiber containing moisture or an inorganic matter. Fine pores generated in the calcined fiber after thermal decomposition has a size of 3–5 nm, for example, in a fiber of mullite composition with a fiber diameter of 3 $\mu$m, and the specific surface area is extremely large as 150–200 $m^2/g$. The calcined fiber is further densed according to the rise of the thermal treatment temperature to finally precipitate mullite crystal. The specific surface area at this time is about 10 $m^2/g$. Since the specific surface area of an amorphous inorganic fiber having a fiber diameter of 2 $\mu$m is 1–2 $m^2/g$, however, the crystalline inorganic fiber has a surface area about 10 times. Accordingly, the fiber surface area forming the reaction surface is extremely large still, extending from the calcined body to the final product.

Further, since the solid thickness is small with a fiber diameter of 3–10 $\mu$m, purification (removal of impurities) can be performed also in the form of a tubular, plate-like or paper-like molded body of the fiber.

In the manufacturing method of this invention, the reaction progresses incomparably to the conventional method because of the large reaction interface. Accordingly, a high-purity fiber containing 1 ppm or less of alkali metal such as Na and essential heavy metal elements such as Fe, Cu and Ni can be obtained although it depends on the purities of the raw materials, and its manufacture can be also facilitated.

The mechanism of the purification is considered as follows.

(1) Chlorine associates with an impurity element present in the inner part of a fiber solid. Otherwise, chlorine associates with the impurity element present on the surface of the fiber solid.

(2) The chloride of the impurity element is diffused to the fiber surface. Otherwise, the internal impurity element of the fiber is diffused to the surface of the fiber surface.

(3) The chloride of the impurity element is evaporated.

(4) The evaporated chloride of the impurity element is carried out of the system.

As a result of the earnest studies by the present inventors, it was clarified that the removal of alkali metal and alkali earth metal from the inorganic fiber mainly composed of alumina and silica, or of alumina, silica and zirconia is more effective as the temperature is higher. With consideration of various industrial conditions, temperature of 1100° C. or higher is preferred.

The higher temperature in the purification requires a consideration in respect to the problem caused in the crystalline inorganic fiber. Namely, the chlorine-containing atmosphere removes even alumina or zirconia that is the main component of the fiber together.

In Japanese Patent Application Laid-Open No. 8-40765, it is described that evaporation of alumina progresses when an alumina porous body is exposed to the atmosphere containing hydrogen chloride at a high temperature of 1200° C. or higher.

On the other hand, the studies by the present inventors revealed that remarkable evaporation of alumina never progresses even if a crystalline inorganic fiber mainly composed of alumina and silica and a molded body mainly started from this fiber are exposed to the atmosphere containing chlorine at 1400° C. In order to clearly show the difference between the both, the surface of the purified crystalline inorganic fiber was analyzed by use of Auger electron spectroscopy. At a result, it was confirmed that the silica content on the fiber pole surface part is high several times in a fiber composed of 72 wt % of alumina and 28 wt % of silica. It can be estimated from this fact that the alumina on the pole surface part is selectively attacked, and evaporated and removed as aluminum chloride when the crystalline inorganic fiber containing alumina and silica is heated to a high temperature in the atmosphere containing chlorine or a chlorine compound, and the remaining silica covers the fiber surface as a protecting film, so that the reaction of the alumina under the protecting film with the purifying gas is suppressed to limit the evaporation of alumina.

The impurities not removed by the purification treatment are not substantially released, since the moving speed of the impurities is slow as long as the fiber is used at a temperature lower than the temperature of the purification treatment. Accordingly, the pollution with the impurities contained in the fiber never occurs.

As the industrial purification condition, treatment temperature, treatment time, chlorine concentration, gas flow velocity, kind of dilute gas, quantity and form of a matter to be treated, and quantity of impurity are parameters to be considered.

The treatment temperature is set in a range where chlorine can be reacted with the impurities so quickly that the reaction of chlorine with the main component is not remarkable. The upper limit of the temperature is, for example, the temperature at which the main component other than silica is not remarkably evaporated by the reaction with chlorine or the like. It is also the temperature at which the progress of growth of the crystal never causes an excessive reduction in the strength of the fiber or in the strength or toughness of the molded body product. Further, the limitation by device is also added. The lower limit of the temperature is the temperature at which the removing reaction of the impurities never requires a long time as deviates the industrial range. In consideration thereof, the purification treatment temperature is preferably set to 600–1500° C., more preferably, to 1100–1500° C.

The treatment time is determined, considering various conditions such as the quantity to manufacture per unit time, the limitation by device, and the ensuring of uniformity of treatment form, and the like. From the viewpoint of productivity and reality, the range from several 10 minutes to several hours is desirable.

The using quantity of the atmospheric gas has an influence on the cost. Although the using quantity corresponds to concentration×flow rate×time when steadily considered, an intermittent method is also effective. In order to discharge the reacted chloride out of the system and prevent the re-pollution, particularly, in order to reduce the chloride concentration of the impurities in the cooling process, the flow velocity and flow rate of the atmospheric gas mainly composed of a carrier gas are necessary.

The chlorine concentration is generally considered to be the necessary quantity for converting the contained impurity to the chloride. Since chlorine is not entirely used for the purification, however, it is efficiently used in a quantity several times the necessary quantity.

Since the thermal treatment is performed in gas atmosphere containing chlorine element in the manufacture of the crystalline inorganic fiber and molded body thereof according to this invention, a remarkable effect can be provided in the removable of impurities from the crystalline inorganic fiber and molded body thereof.

The high purity crystalline inorganic fiber and molded body thereof according to this invention can be safely used for a long time without polluting the wafer to be treated and contribute to the improvement in quality and productivity of the matter to be heated.

Particularly, the use as the heat insulating material for semiconductor manufacturing device can increase the freedom in device design and lead to an improvement in through put of the semiconductor manufacture so as to be contributable to the reduction in total cost of the semiconductor, because the contamination resulted from the heat insulating material never occurs.

EMBODIMENTS

Preferred embodiments of this invention will next be described.

EXAMPLE 1

A mixture was prepared by mixing 62 parts by weight of a basic aluminum chloride solution (Al/Cl=1.7, $Al_2O_3$ solid content 23.5%), 28 parts by weight of colloidal silica ($SiO_2$ solid content 20.0%), and 10 parts by weight of lactic acid (concentration 50%). This mixture was condensed to regulate the viscosity to 200 poises. The regulated solution was fiberized according to a known method to provide a precursor fiber having an average diameter of 3 $\mu$m. The precursor fiber was heated in air at 700° C. for 2 hours to provide a calcined fiber as a sample 1.

The sample 1 was heated in air at 1250° C. for 2 hours to form a sample 2.

The sample 1 was treated in an argon gas flow containing 30% hydrogen chloride. The supply of hydrogen chloride was started from 500° C., and only argon gas was supplied up to 500° C. The treatment temperature was set to 1000° C., 1100° C., 1200° C., 1300° C., and 1400° C. The treatment time at each temperature was set to 1 hour. The thus-treated samples were taken as samples 3, 4, 5, 6, and 7 according to the difference in temperature.

The sample 2 was heated in an argon gas flow containing 30% hydrogen chloride at 1400° C. for 1 hour to form a sample 8.

Table 1 shows the impurity quantity (unit: ppm) of each sample. Na and Ca are elements devitrifying quartz glass, and Fe, Cu and Ni essential heavy metal elements contaminating a silicon wafer.

From the change of the above treatment condition and the result of Table 1, it is found that the impurities can be reduced by several digits.

With respect to the samples 2, 3, and 4, the quantity of polluting quartz glass was measured. A cylinder having an inside diameter of 150 mm, an outer diameter of 200 mm and a length of 300 mm was manufactured from each sample. It was set on the outside of a quartz glass pipe having an outer diameter of 130 mm and a thickness of 5 mm and manufactured by VAD method, a silicon carbide pipe impregnated with silicon was further set on the outside thereof in order to eliminate the influence from a heater, and the whole body was heated in pure air at 1150° C. for 10 hours. After allowed to cool, the degree of devitrification of the quartz glass tube was observed. The quartz glass tube was dissolved from the outside by 10 μm, and the impurity quantity (unit: ppm) contained therein was measured. The result is shown in Table 2.

With respect to the samples 2, 3 and 4, the quantity of polluting a silicon wafer was measured. One gram of each sample was put on the silicon wafer by, and heated at 1150° C. for 10 hours. After allowed to cool, the surface of the silicon wafer was dissolved, and the impurity quantity contained therein (unit: $10^{10}$ atoms/$cm^2$) was measured. The result is shown in Table 3. In the sample 4, Na, Ca and heavy metal elements were as little as the pollution of the silicon wafer is out of the question.

EXAMPLE 2

Aluminum alkoxide was put in a solution of alcohol and dilute hydrochloric acid, and the alkoxide was hydrolyzed to provide a suspension containing 30% aluminum hydroxide fine particle. A suspension of silica and a suspension of zirconia were prepared in the same manner. These suspensions were mixed so that the ratios of alumina, silica and zirconia are 60 parts, 20 parts and 20 parts, respectively. To this mixture, 2 parts, per 100 parts of the fine particle thereof, of PVP (polyvinyl pyrolidone) was added, and fiberization was performed according to a known method to provide a long fiber having an average diameter of 10 μm. This fiber was heated in air at 900° C. for 2 hours to provide a calcined fiber as a sample 9. The sample 9 was heated in air at 1200° C. for 2 hours to provide a crystalline fiber as a sample 10. The sample 9 was heated in an argon gas flow containing 1% chlorine gas at 1200° C. for 1 hour to provide a dense fiber as a sample 11.

The impurity quantity (unit: ppm) of each sample was measured. The result is shown in Table 4.

It is apparent that the method according to this invention is effective also for alumina-silica-zirconia fiber.

EXAMPLE 3

To 50 l of water, 150 g of the sample 1 and 350 g of alumina powder were mixed and dispersed. Thereafter, 30 g of positive starch and 30 g, in terms of solid content, of colloidal silica of low soda were added thereto to form a slurry. The slurry was vacuum molded to manufacture a board having a thickness of 20 mm and a size of 100 mm square. The board was heated in a nitrogen gas flow containing 30% ammonium chloride at 1300° C. for 2 hours. At this time, the supply of ammonium chloride was performed also in the temperature raising process. The resulting product is taken as a sample 12.

As a contrast, a sample 13 was produced in the same manner as in the sample 12 except using air instead of the nitrogen gas containing 30% ammonium chloride.

The impurity quantity (unit: ppm) of each sample is shown in Table 5.

The method according to this invention is highly effective for a product molded in a plate with addition of ceramic powder.

EXAMPLE 4

A mixture was prepared by mixing 62 parts by weight of a basic aluminum chloride solution (Al/Cl=1.7, $Al_2O_3$ solid content 23.5%), 28 parts by weight of colloidal silica ($SiO_2$ solid content 20.0%), and 10 parts by weight of lactic acid (concentration 50%). This mixture was condensed to regulate the viscosity to about 200 poises. The regulated solution was fiberized according to a known method to provide a precursor fiber having an average diameter of 3 μm. The precursor fiber was heated in air at 700° C. for 2 hours to provide a calcined fiber as a sample 21.

The sample 21 was heated in air at 1250° C. for 2 hours to form a sample 22.

The sample 21 was treated in an argon gas flow containing 10% hydrogen chloride. The supply of hydrogen chloride was started after the temperature reaches a prescribed treatment temperature. The treatment temperature was set to 800° C., 1000° C., 1200° C., and 1400° C. The treatment time at each temperature was set to 2 hours. The thus-treated samples were taken as samples 23, 24, 25, and 26 according to the difference in temperature.

The sample 22 was heated in an argon gas flow containing 10% hydrogen chloride at 1300° C. for 2 hour to form a sample 27.

Further, the sample 21 was treated in an argon gas flow containing 10% hydrogen chloride at 1400° C. for 2 hours. The supply of hydrogen chloride was started from the temperature raising process. The treated matter of this sample is taken as a sample 28.

The impurity quantity of each sample (unit: ppm) is shown in Table 6.

From the change of the above treatment condition and the result of Table 1, it is found that the impurities can be reduced by several digits, and the removable impurity elements can be increased by selecting the supplying condition of chlorine gas.

With respect to the samples 22 and 28, the quantity of polluting quartz glass was measured. A cylinder having an inside diameter of 150 mm, an outer diameter of 200 mm and a length of 300 mm was manufactured from each sample 22 and 28. It was set on the outside of a quartz glass pipe having an outer diameter of 130 mm and a thickness of 5 mm and manufactured by VAD method, a silicon carbide pipe impregnated with silicon was further set on the outside thereof in order to eliminate the influence from a heater, and the whole body was heated in pure air at 1150° C. for 10 hours. After allowed to cool, the quartz glass tube was dissolved from the outside by 10 μm, and the impurity quantity (unit: ppm) contained therein was measured. Tho result is shown in Table 7.

With respect to the samples 22 and 28, the quantity of polluting a silicon wafer was measured. One gram of each sample was put on the silicon wafer and heated at 1000° C. and 1200° C. for 2 hours. After allowed to cool, the surface of the silicon wafer was dissolved, and the impurity quantity contained therein (unit: $10^{10}$ atoms/$cm^2$) was measured. The result is shown in Table 8.

The practical limit of impurities was then evaluated. One gram of each of the samples 22, 23, and 25 was put on a quartz glass wafer having an outer diameter of 6 inches and a thickness of 0.6 mm and manufactured by VAD method. This was set on a silicon wafer with a space of 5 mm, and heated at 1200° C. for 10 hours. After allowed to cool, the impurity quantity (unit. $10^{10}$ atoms/$cm^2$) was measured. The result is shown in Table 9.

From the result shown in Table 9, it was clarified that a crystalline inorganic fiber containing 10 ppm or less of Fe, 0.5 ppm or less of Cu and 0.2 ppm or less of Ni can be used under the condition of the same chamber as the silicon wafer and a high temperature in the semiconductor manufacturing process, depending on the using condition.

EXAMPLE 5

Aluminum alkoxide was put in a solution of alcohol and dilute hydrochloric acid, and the alkoxide was hydrolyzed to provide a suspension containing 30% aluminum hydroxide fine particle. Two parts, per 100 parts of the fine particle thereof, of PVP polyvinyl pyrolidone) was added, and fiberization was performed according to a known method to provide a long fiber having an average diameter of 10 $\mu$m. This fiber was heated in air at 900° C. for 2 hours to form a sample 29.

A sample 30 was prepared in the same manner as in the sample 29 except using zirconium alkoxide instead of aluminum alkoxide.

A sample 31 was prepared in the same manner as in the sample 29 except mixing the suspensions used in the samples 29 and 30 and using the mixture as suspension.

The sample 31 was heated in air at 1100° C. for 2 hours to form a sample 32.

The samples 29, 30 and 31 were thermally treated in an argon gas flow containing 1% chlorine gas at 1100° C. for 1 hour. The resulting products are taken as samples 33, 34, and 35, respectively.

The impurity quantity (unit: ppm) of each sample was shown in Table 10.

EXAMPLE 6

To 50 l of water, 150 g of the sample 21 and 350 g of alumina powder were mixed and dispersed. Thereafter, 30 g of positive starch and 30 g, in terms of solid content, of colloidal silica of low soda were added thereto to form a slurry. The slurry was vacuum molded to manufacture a board having a thickness of 20 mm and a size of 100 mm square. The board was heated in a nitrogen gas flow containing 30% ammonium chloride at 1300° C. for 2 hours. At this time, the supply of ammonium chloride was performed also in the temperature raising process. The resulting product is taken as a sample 36.

As a contrast, a sample 37 was produced in the same manner as in the sample 36 except using air instead of the nitrogen gas containing 30% ammonium chloride.

The impurity quantity (unit: ppm) of each sample is shown in Table 11.

TABLE 1

| | Na | Ca | Fe | Cu | Ni |
|---|---|---|---|---|---|
| sample 1 | 830 | 80 | 160 | 2.2 | 2.5 |
| sample 2 | 890 | 90 | 150 | 1.2 | 1.3 |
| sample 3 | 200 | 80 | 0.6 | 0.5 | 0.2 |
| sample 4 | 30 | 70 | ≦0.1 | ≦0.1 | ≦0.1 |
| sample 5 | 10 | 40 | ≦0.1 | ≦0.1 | ≦0.1 |
| sample 6 | 0.5 | 15 | ≦0.1 | ≦0.1 | ≦0.1 |
| sample 7 | 0.2 | 12 | ≦0.1 | ≦0.1 | ≦0.1 |
| sample 8 | 3 | 28 | 9 | 0.1 | ≦0.1 |

TABLE 2

| | depth of quartz glass tube | Na | Ca | Fe | Ni | Cu | devitrification |
|---|---|---|---|---|---|---|---|
| sample 2 | 0~10 | 425 | 15 | 10.5 | 0.3 | 0.2 | large |
| | 10~20 | 250 | 5 | 2.4 | 0.2 | 0.1 | |
| | 20~30 | 140 | 1 | 1.3 | 0.1 | 0.1 | |
| | 30~40 | 80 | 0.2 | 1.0 | 0.1 | 0.1 | |

TABLE 2-continued

| | depth of quartz glass tube | Na | Ca | Fe | Ni | Cu | devitrification |
|---|---|---|---|---|---|---|---|
| sample 3 | 0~10 | 95 | 30 | 0.1 | 0.3 | 0.1 | small |
| | 10~20 | 40 | 4 | 0.05 | 0.2 | 0.05 | |
| | 20~30 | 18 | 0.8 | 0.02 | 0.05 | 0.03 | |
| | 30~40 | 8 | 0.2 | 0.01 | 0.05 | 0.02 | |
| sample 4 | 0~10 | 3 | 20 | 0.02 | 0.02 | 0.02 | non |
| | 10~20 | 1.5 | 3 | 0.01 | 0.01 | 0.01 | |
| | 20~30 | 0.7 | 0.5 | 0.01 | 0.01 | 0.01 | |
| | 30~40 | 0.3 | 0.1 | 0.01 | 0.01 | 0.01 | |

TABLE 3

| | Na | Ca | Fe | Ni | Cu |
|---|---|---|---|---|---|
| sample 2 | 200 | 15 | 80 | 14 | 7 |
| sample 3 | 90 | 8 | 1.5 | 0.2 | 0.2 |
| sample 4 | 3 | 4 | 0.1 | 0.1 | 0.1 |

TABLE 4

| | Na | Ca | Fe | Cu | Ni |
|---|---|---|---|---|---|
| sample 9 | 30 | 12 | 0.8 | 0.3 | 0.3 |
| sample 10 | 60 | 25 | 1.2 | 0.4 | 0.3 |
| sample 11 | 2 | 8 | ≦0.1 | ≦0.1 | ≦0.1 |

TABLE 5

| | Na | Ca | Fe | Cu | Ni |
|---|---|---|---|---|---|
| sample 12 | 15 | 25 | 8 | 0.1 | 0.1 |
| sample 13 | 650 | 85 | 320 | 3.5 | 4.5 |

TABLE 6

| | Fe | Cu | Ni |
|---|---|---|---|
| sample 21 | 160 | 2.2 | 2.5 |
| sample 22 | 150 | 1.2 | 1.3 |
| sample 23 | 0.6 | 0.5 | 0.2 |
| sample 24 | <0.1 | 0.1 | <0.1 |
| sample 25 | 10 | 0.1 | <0.1 |
| sample 26 | 120 | 0.2 | <0.1 |
| sample 27 | 100 | 0.1 | <0.1 |
| sample 28 | <0.1 | <0.1 | <0.1 |

TABLE 7

| | depth of quartz glass tube | Fe | Ni | Cu |
|---|---|---|---|---|
| sample 22 | 0~10 $\mu$m | 10.5 | 0.3 | 0.2 |
| | 10~20 | 2.4 | 0.2 | 0.1 |
| | 20~30 | 1.3 | 0.1 | 0.1 |
| | 30~40 | 1.0 | 0.1 | 0.1 |
| sample 28 | 0~10 $\mu$m | 0.02 | 0.01 | 0.01 |
| | 10~20 | 0.01 | 0.01 | 0.01 |
| | 20~30 | 0.01 | 0.01 | 0.01 |
| | 30~40 | 0.01 | 0.01 | 0.01 |

TABLE 8

| | temperature | Fe | Ni | Cu |
|---|---|---|---|---|
| sample 22 | 1000° C. | 28 | 9 | 5 |
| | 1200° C. | 130 | 23 | 8 |
| sample 28 | 1000° C. | 0.1 | 0.1 | 0.1 |
| | 1200° C. | 0.3 | 0.3 | 0.3 |

TABLE 9

| | Fe | Cu | Ni |
|---|---|---|---|
| sample 22 | 25 | 10 | 8 |
| sample 23 | 0.2 | 0.4 | 0.3 |
| sample 25 | 0.5 | 0.1 | 0.1 |

TABLE 10

| | Fe | Cu | Ni |
|---|---|---|---|
| sample 29 | 0.8 | 0.3 | 0.3 |
| sample 30 | 1.2 | 0.4 | 0.3 |
| sample 31 | 1.0 | 0.4 | 0.3 |
| sample 32 | 1.2 | 0.2 | 0.2 |
| sample 33 | <0.1 | <0.1 | <0.1 |
| sample 34 | <0.1 | <0.1 | <0.1 |
| sample 35 | <0.1 | <0.1 | <0.1 |

TABLE 11

| | Fe | Cu | Ni |
|---|---|---|---|
| sample 36 | 8 | 0.1 | 0.1 |
| sample 37 | 320 | 3.5 | 4.5 |

What is claimed is:

1. A method comprising a step of preparing a crystalline inorganic fiber or a molding of the fiber, and a step of thermally treating the crystalline inorganic fiber or the molding of the fiber in gas atmosphere containing chlorine.

2. A method according to claim 1 wherein the crystalline inorganic fiber includes a main component which consists of at least one of alumina, silica and zirconia.

3. A method comprising a step of preparing a crystalline inorganic fiber, a calcined crystalline inorganic fiber or a molding composed mainly of the crystalline inorganic fiber, and a step of thermally treating the crystalline inorganic fiber, the calcined crystalline inorganic fiber, or the molding in gas atmosphere containing chlorine at a temperature of 600–1500° C.

4. A method according to claim 3 wherein the crystalline inorganic fiber, the calcined fiber or the molding is thermally treated in gas atmosphere containing chlorine at a temperature of 1100–1500° C.

5. A method according to claim 1 wherein the gas atmosphere containing chlorine contains chlorine gas, hydrogen chloride or ammonium chloride.

6. A high-purity crystalline inorganic fiber or a molding of the fiber wherein Fe, Cu and Ni contained in the crystalline inorganic fiber or the molding produced by the method according to claim 1 are 15 ppm or less, 1 ppm or less, and 0.5 ppm or less, respectively, in contents.

7. A high-purity crystalline inorganic fiber or the molding according to claim 6 wherein the crystalline inorganic fiber is mainly composed of at least one of alumina, silica and zirconia.

8. A high-purity crystalline inorganic fiber containing Fe which is 10 ppm or less, Cu which is 0.5 ppm or less, and Ni which is 0.2 ppm or less, the crystalline inorganic, fiber being mainly composed of at least one of alumina, silica and zirconia.

9. A high-purity crystalline inorganic fiber according to claim 8, containing Na which is 50 ppm or less.

10. A high-purity crystalline inorganic fiber according to claim 8, containing Ca which is 75 ppm or less.

11. A high-purity crystalline inorganic fiber according to claim 8 wherein the crystalline inorganic fiber is mainly composed of alumina and silica, or of alumina, silica and zirconia.

12. A high-purity crystalline inorganic fiber according to claim 11 wherein the fiber has a high silica concentration on the surface.

13. A molding composed mainly of the fiber according to claim 8.

* * * * *